US005559077A

United States Patent [19]

Martin

[11] Patent Number: 5,559,077

[45] Date of Patent: Sep. 24, 1996

[54] ANTISTATIC BACKING LAYER FOR TRANSPARENT RECEIVER USED IN THERMAL DYE TRANSFER

[75] Inventor: Thomas W. Martin, Rochester, N.Y.

[73] Assignee: Eastman Kodak Company, Rochester, N.Y.

[21] Appl. No.: 459,391

[22] Filed: Jun. 2, 1995

Related U.S. Application Data

[63] Continuation-in-part of Ser. No. 312,201, Sep. 26, 1994.

[51] Int. Cl.[6] ..... B41M 5/035; B41M 5/38

[52] U.S. Cl. ..... 503/227; 428/195; 428/206; 428/327; 428/341; 428/913; 428/914

[58] Field of Search ..... 8/471; 428/195, 428/206, 327, 341, 913, 914; 503/227

[56] References Cited

U.S. PATENT DOCUMENTS

| | | | |
|---|---|---|---|
| 4,814,321 | 3/1989 | Campbell | 503/227 |
| 5,198,410 | 3/1993 | Martin | 503/227 |
| 5,252,535 | 10/1993 | Martin et al. | 503/227 |

FOREIGN PATENT DOCUMENTS

| | | | |
|---|---|---|---|
| 407220 | 1/1991 | European Pat. Off. | 503/227 |

*Primary Examiner*—B. Hamilton Hess
*Attorney, Agent, or Firm*—Harold E. Cole

[57] ABSTRACT

A dye-receiving element for thermal dye transfer comprising a transparent support having on one side thereof a polymeric dye image-receiving layer and on the other side thereof an antistatic backing layer which contains polymeric particles which are deformation-resistant.

20 Claims, No Drawings

ANTISTATIC BACKING LAYER FOR TRANSPARENT RECEIVER USED IN THERMAL DYE TRANSFER

CROSS-REFERENCE TO RELATED APPLICATIONS

This is a continuation-in-part of application Ser. No. 08/312,201, filed Sep. 26, 1994.

This invention relates to transparent dye-receiving elements used in thermal dye transfer, and more particularly to an antistatic backing layer for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Dye receiving elements for thermal dye transfer generally include a transparent or reflective support bearing on one side thereof a dye image-receiving layer and on the other side thereof a backing layer. As set forth in U.S. Pat. Nos. 5,011,814 and 5,096,875, the disclosures of which are incorporated by reference, the backing layer material is chosen to (1) provide adequate friction to a thermal printer rubber pick roller to allow for removal of one receiver element at a time from a thermal printer receiver element supply stack, (2) minimize interactions between the front and back surfaces of receiving elements such as dye retransfer from one imaged receiving element to the backing layer of an adjacent receiving element in a stack of imaged elements, and (3) minimize sticking between a dye-donor element and the receiving element backing layer when the receiving element is accidentally inserted into a thermal printer wrong side up.

Additionally, especially for transparent receiving elements (e.g., elements used for printing overhead transparencies, the supports of which generally comprise smooth polymeric films), static charges may be easily generated upon transport of the elements through a thermal printer. As such, it is preferable for the backing layer (or an additional layer) to provide sufficient surface conductivity to dissipate such charges. Also, the backing layer for transparent elements must itself be transparent.

One transparent backing antistatic layer which has found use for dye-receiving elements is a mixture of poly(vinyl alcohol) crosslinked with VOLAN® (an organo-chromic chloride from DuPont), potassium chloride, poly(methyl methacrylate) beads (3–5 mm), and Saponin® (surfactant coating aid from Eastman Kodak). This backing layer has excellent clarity and functions well to minimize interactions between the front and back surfaces of receiving elements. This backing layer also provides adequate friction to a rubber pick roller to allow removal of one receiving element at a time from a stack. This backing layer, however, may stick to a dye-donor element at high printer head voltages when the receiving element is used wrong side up, and does not provide as high a level of surface conductivity as may be desired to dissipate charges generated upon transport of the elements through a thermal printer. While additional ionic antistatic agents may be added to the layer, such additional agents may adversely affect the clarity of the backing layer.

U.S. Pat. Nos. 4,814,321, 5,198,410 and 5,252,535 disclose backing layers for dye-receiving elements. However, there is a problem with the antistatic backing layers described in U.S. Pat. No. 4,814,321 in that their friction and anti-blocking characteristics are significantly affected by the relative humidity of the environment. At relative humidity values exceeding about 70%, individual receiver sheets cannot be picked up and transported by the picker in a repeatable manner. There is also a problem with the backing layers described in U.S. Pat. Nos. 5,198,410 and 5,252,535 in that they contain polymeric particles that are compressed and flattened during a wide-roll manufacturing process in which the rolls are wound up under a compressive force of about 200–300 kg/m$^2$. Consequently, the receiver sheets with such backing layers tend to stick to one another, with the result that multiple sheets are transported from the receiver tray during the print cycle.

It is an object of this invention to provide a transparent backing layer for a dye-receiving element which would minimize interactions between the front and back surfaces of such elements, provide adequate friction to a thermal printer rubber pick roller to allow for removal of receiver elements one at a time from a receiver element supply stack, minimize sticking to a dye-donor element during the printing process, and provide sufficient surface conductivity to dissipate charges generated upon transport of the elements through a thermal printer.

These and other objects are achieved in accordance with this invention which comprises a dye-receiving element for thermal dye transfer comprising a transparent support having on one side thereof a polymeric dye image-receiving layer and on the other side thereof an antistatic backing layer which contains polymeric particles which are deformation-resistant.

Polymeric particles which are deformation-resistant are defined as spherical particles that resist being compressed and permanently flattened during a wide-roll manufacturing process as described above. Deformation-resistant particles useful in the invention include: divinylbenzene beads, beads of polystyrene crosslinked with at least 20 wt. % divinylbenzene, or beads of poly(methyl methacrylate) crosslinked with at least 20 wt. % of divinylbenzene, acrylic acid or 2-hydroxyethyl methacrylate, or the like. In a preferred embodiment of the invention, the deformation-resistant particles are divinylbenzene beads. In general, these beads have a particle size of from about 1 μm to about 15 μm, more preferably from about 2 μm to 12 μm. They may comprise about 0.2 to 30 wt. % of the backing layer mixture, corresponding to about 0.006 g/m$^2$ to about 0.050 g/m$^2$.

The process of forming a dye transfer image in a dye-receiving element in accordance with this invention comprises removing an individual dye-receiving element as described above from a supply stack of dye-receiving elements, moving the individual receiving element to a thermal printer printing station and into superposed relationship with a dye-donor element comprising a support having thereon a dye-containing layer so that the dye-containing layer of the donor element faces the dye image-receiving layer of the receiving element, and imagewise heating the dye-donor element thereby transferring a dye image to the individual receiving element. The process of the invention is applicable to any type of thermal printer, such as a resistive head thermal printer, a laser thermal printer, or an ultrasound thermal printer.

Typical components of an antistatic backing layer generally include an antistatic material and a binder system such as an organo-clay binder, ionic polymers, poly(ethylene oxide) or poly(vinyl alcohol), submicron colloidal inorganic particles such as colloidal silica, coating aids, etc. Examples of binders useful in this invention are found in U.S. Pat. Nos. 4,814,321, 5,198,410 and 5,252,535, the disclosures of which are hereby incorporated by reference. In a preferred embodiment of the invention, the binder in the backing layer comprises colloidal silica, polyethylene oxide and polyvinyl alcohol.

Submicron colloidal inorganic particles described above in the typical backing layer preferably comprise from about 10 to about 40 wt. %, preferably about 15 to about 30 wt. % of the backing layer mixture. While any submicron colloidal inorganic particles may be used, the particles preferably are water-dispersible and less than 0.1 μm in size, and more preferably from about 0.01 to 0.05 μm in size. There may be used, for example, silica, alumina, titanium dioxide, barium sulfate, etc. In a preferred embodiment, silica particles are used.

Ionic antistatic agents useful in the backing layer of the invention as described above include materials such as potassium chloride, vanadium pentoxide, or others known in the art. The backing layer of the invention has the advantage of minimizing the amount of ionic antistatic agent which must be added to provide a desired level of surface conductivity.

The transparent support for the dye-receiving element of the invention includes films of poly(ether sulfone(s)), polyimides, cellulose esters such as cellulose acetate, poly(vinyl alcohol-co-acetal(s)), and poly(ethylene terephthalate). The support may be employed at any desired thickness, usually from about 10 μm to 1000 μm. Additional polymeric layers may be present between the support and the dye image-receiving layer. In addition, subbing layers may be used to improve adhesion of the dye image-receiving layer and backing layer to the support.

In the thermal dye-transfer transparency receivers of the invention, a total backing layer coverage of from about 0.1 to about 0.6 g/m$^2$ is preferred. Backing layer coverages greater than 0.6 g/m$^2$ tend to have too much haze for transparency applications. For these backing layers, the total amount of polymeric binder preferably comprises from about 50 to 85 wt. % of the backing layer, and a total polymeric binder coverage of about 0.05 to 0.45 g/m$^2$ is preferred. An especially preferred polymer coverage is polyethylene oxide at about 0.02 g/m$^2$. The total polymer coverage is more preferably maintained below 0.25 g/m$^2$ to avoid haze.

The dye image-receiving layer of the receiving elements of the invention may comprise, for example, a polycarbonate, a polyurethane, a polyester, poly(vinyl chloride), poly(styrene-co-acrylonitrile), polycaprolactone or mixtures thereof. The dye image-receiving layer may be present in any amount which is effective for the intended purpose. In general, good results have been obtained at from about 1 to about 10 g/m$^2$. An overcoat layer may be further coated over the dye-receiving layer such as those described in U.S. Pat. No. 4,775,657, the disclosure of which is incorporated by reference.

Conventional dye-donor elements may be used with the dye-receiving element of the invention. Such donor elements generally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

The dye-donor element employed in certain embodiments of the invention may be used in sheet form or in a continuous roll or ribbon. If a continuous roll or ribbon is employed, it may have only one dye thereon or may have alternating areas of different dyes such as cyan, magenta, yellow, black, etc., as disclosed in U.S. Pat. No. 4,541,830.

In a preferred embodiment of the invention, a dye-donor element is employed which comprises a poly(ethylene terephthalate) support coated with sequential repeating areas of cyan, magenta and yellow dye, and the dye transfer process steps are sequentially performed for each color to obtain a three-color dye transfer image.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer, such as laser or ultrasound, may be used.

A thermal dye transfer assemblage of the invention comprises a) a dye-donor element as described above, and b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought into register with the dye-receiving element and the process repeated. The third color is obtained in the same manner.

The following example is provided to further illustrate the invention.

EXAMPLE

Control:

A dispersion was prepared and coated from water on the back side of a 118 μm poly(ethylene terephthalate) support (PET) with a coating of poly(acrylonitrile-co-vinylidene chloride-co-acrylic acid) (14:79:7 wt ratio) on both sides. This coating contained beads of polystyrene crosslinked with only 5 wt. % divinyl benzene. Materials used and solids laydowns were as follows:

| Material | g/m² |
|---|---|
| Polyox® WSR N-10 poly(ethylene oxide), MW 900,000 (Scientific Polymer Products) | 0.019 |
| Ludox AM® (aqueous dispersion of alumina-modified colloidal silica particles, 13 μm) (DuPont Corp.) | 0.027 |
| potassium chloride | 0.007 |
| styrene/divinylbenzene (95:5) beads, 4 μm | 0.026 |
| Colloids 7190-25 (poly(vinyl alcohol)) (Colloid Industries) | 0.064 |
| Triton X-200E® (a sulfonated aromatic-aliphatic surfactant) (Rohm and Haas Co.) | 0.0003 |
| APG-225 (a glycoside surfactant) (Henkel Co.) | 0.0005 |

Test Sample E-1:

This element is the same as the Control above except that divinylbenzene beads (100% crosslinked) (4 μm) were used instead of beads of polystyrene crosslinked with only 5 wt. % divinyl benzene Test Sample E-2:

This element is the same as E-1 above except that divinylbenzene beads (100% crosslinked) (2 μm) were used at a coverage of 0.006 g/m².

Test Sample E-3:

This sample was prepared in the same manner as those above with the following solids laydowns:

| Material | g/m² |
|---|---|
| Polyox® WSR N-10 poly(ethylene oxide), MW 900,000 (Scientific Polymer Products) | 0.039 |
| Ludox AM® (aqueous dispersion of alumina-modified colloidal silica particles, 13 μm) (DuPont Corp.) | 0.054 |
| potassium chloride | 0.007 |
| divinylbenzene beads 4 μm | 0.019 |
| Colloids 7190-25 (poly(vinyl alcohol)) (Colloid Industries) | 0.129 |
| Triton X-200E® (a sulfonated aromatic-aliphatic surfactant) (Rohm and Haas Co.) | 0.0003 |
| APG-225 (a glycoside surfactant) (Henkel Co.) | 0.0005 |

Test Sample E-4:

This sample was prepared in the same manner as those above with the following solids laydowns:

| Material | g/m² |
|---|---|
| Polyox® WSR N-10 poly(ethylene oxide), MW 900,000 (Scientific Polymer Products) | 0.039 |
| Ludox AM® (aqueous dispersion of alumina-modified colloidal silica particles, 13 μm) (DuPont Corp.) | 0.027 |
| potassium chloride | 0.007 |
| styrene/divinylbenzene (70:30) beads, 5 μm | 0.026 |
| Elvanol® 71-30 poly(vinyl alcohol) (DuPont Corp.) | 0.129 |
| Triton X-200E® (a sulfonated aromatic-aliphatic surfactant) (Rohm and Haas Co.) | 0.0003 |
| APG-225 (a glycoside surfactant) (Henkel Co.) | 0.0005 |

To evaluate sliding friction between the backing layer of one receiver element and the receiving layer of an adjacent element, a first receiver element was taped to a stationary support with the backing layer facing up. A second receiver element was then placed with its receiving layer face down against the backing layer of the first element. A 1.5 kg steel weight was placed over the two receiver elements, covering an area approximately 10 cm by 12 cm. A cam driven strain gauge was attached to the second (upper) receiver element and advanced about two cm at a rate of 0.25 cm/sec. The maximum pull forces in kg for the various receivers were measured at about 1 s. into the pull and are indicated in the Table below. In actual practice, it has been found that the pull forces of less than about 5N (0.5 kg) are desirable to prevent blocking or multiple feeding. Two samples of each experiment were measured at standard conditions (25° C. and 50% RH) and the values were averaged.

The morphology of the polymeric particles incorporated in the test backing layers of receiver sheets that had been through the manufacturing process of coating in wide-roll format as described above and that had been stored, finished into 22 cm×28 cm (8.5"×11.0") sheets, and packaged, were examined by scanning electron microscopy to determine whether the matte particles were flattened or remained spherical in shape after manufacturing.

The coatings were visually evaluated and have excellent clarity similar to window glass.

Surface resistivity was measured using a surface resistivity measurement gauge. The surface resistivity values were obtained at 20° C., 50% RH.

The test results are summarized in the following Table:

TABLE

| SAMPLE | SLIDING FRICTION (kg) | Surface Resistance $\times 10^{12}$ Ω/□ | BEAD SHAPE |
|---|---|---|---|
| Control | 0.77 | 1.05 | flat |
| E-1 | 0.25 | 0.954 | sphere |
| E-2 | 0.30 | 0.633 | sphere |
| E-3 | 0.30 | 0.768 | sphere |
| E-4 | 0.32 | 1.12 | sphere |

The above results show that most deformation-resistant polymeric particles have a better (lower) surface resistivity than the Control for antistatic performance during transport through a thermal printer, and all of them have a much lower sliding friction than the Control between front and back surfaces, which will provide improved transport through a thermal printer.

The invention has been described in detail with particular reference to preferred embodiments thereof, but it will be understood that variations and modifications can be effected within the spirit and scope of the invention.

What is claimed is:

1. A dye-receiving element for thermal dye transfer comprising a transparent support having on one side thereof a polymeric dye image-receiving layer and on the other side thereof an antistatic backing layer which contains polymeric particles which are deformation-resistant.

2. The element of claim 1 wherein said polymeric particles are selected from the group consisting of divinylbenzene beads, beads of polystyrene crosslinked with at least 20 wt. % divinylbenzene, or beads of poly(methyl methacrylate) crosslinked with at least 20 Wt. % of divinylbenzene, acrylic acid or 2-hydroxyethyl methacrylate.

3. The element of claim 2 wherein said particles comprise divinylbenzene beads.

4. The element of claim 3 wherein the particle size of said beads is from about 2 μm to about 12 μm.

5. The element of claim 3 wherein said beads are present in an amount of from about 0.006 g/m² to about 0.050 g/m².

6. The element of claim 1 wherein the total coverage of the backing layer is from 0.1 to 0.6 g/m².

7. The element of claim 1 wherein the antistatic backing layer comprises an ionic antistatic material and a polymeric binder system.

8. The element of claim 7 wherein the polymeric binder system comprises polyethylene oxide in an amount by weight up to one half the total polymeric binder.

9. The element of claim 8 wherein said polymeric binder system further comprises colloidal silica and polyvinyl alcohol.

10. The element of claim 7 wherein said ionic antistatic material is potassium chloride or vanadium pentoxide.

11. A process of forming a dye transfer image in a dye-receiving element comprising:

(a) removing an individual dye-receiving element comprising a support having on one side thereof a polymeric dye image-receiving layer and on the other side thereof a backing layer from a stack of dye-receiving elements;

(b) moving said individual dye-receiving element to a thermal printer printing station and into superposed relationship with a dye-donor element comprising a support having thereon a dye-containing layer so that the dye-containing layer of the donor element faces the dye image-receiving layer of the receiving element; and (c) imagewise-heating said dye-donor element and thereby transferring a dye image to said individual dye-receiving element;

wherein the backing layer comprises an antistatic backing layer which contains polymeric particles which are deformation-resistant.

12. The process of claim 11 wherein said polymeric particles are selected from the group consisting of divinylbenzene beads, beads of polystyrene crosslinked with at least 20 wt. % divinylbenzene, or beads of poly(methyl methacrylate) crosslinked with at least 20 wt. % of divinylbenzene, acrylic acid or 2-hydroxyethyl methacrylate.

13. The process of claim 12 wherein said particles comprise divinylbenzene beads.

14. The process of claim 13 wherein the particle size of said beads is from about 2 μm to about 12 μm.

15. The process of claim 13 wherein said beads are present in an amount of from about 0.006 $g/m^2$ to about 0.050 $g/m^2$.

16. The process of claim 11 wherein the total coverage of the backing layer is from 0.1 to 0.6 $g/m^2$.

17. The process of claim 11 wherein the antistatic backing layer comprises an ionic antistatic material and a polymeric binder system.

18. The process of claim 17 wherein the polymeric binder system comprises polyethylene oxide in an amount by weight up to one half the total polymeric binder.

19. The process of claim 18 wherein said polymeric binder system further comprises colloidal silica and polyvinyl alcohol.

20. The process of claim 17 wherein said ionic antistatic material is potassium chloride or vanadium pentoxide.

* * * * *